US006385913B1

(12) United States Patent
Ahn

(10) Patent No.: US 6,385,913 B1
(45) Date of Patent: May 14, 2002

(54) STEEL MANHOLE

(76) Inventor: Byung Moo Ahn, 60 Yupnaeri, Yooljin-yup, Yooljin-gun, Kyungsangbuk-do (KR)

( * ) Notice: Subject to any disclaimer, the term of this patent is extended or adjusted under 35 U.S.C. 154(b) by 0 days.

(21) Appl. No.: 09/630,050

(22) Filed: Aug. 1, 2000

(51) Int. Cl.[7] ..... E02D 29/14

(52) U.S. Cl. ..... 52/20; 52/21; 52/19; 52/136; 52/169.6; 404/26; 404/25; 404/2; 404/4; 404/5; 404/74; 404/22; 220/4.12; 220/8

(58) Field of Search ..... 52/20, 136, 21, 52/19, 169.6; 404/26, 25, 2, 4, 5, 74, 22; 220/4.12, 8

(56) References Cited

U.S. PATENT DOCUMENTS 4,805,920 A * 2/1989 Gavin ..... 52/20
5,852,901 A * 12/1998 Meyers ..... 52/20
6,106,196 A * 8/2000 Hantz, Jr. et al. ..... 52/20
6,234,711 B1 * 5/2001 Beaman ..... 52/19

* cited by examiner

*Primary Examiner*—Carl D. Friedman
*Assistant Examiner*—Chi Nguyen
(74) *Attorney, Agent, or Firm*—Ladas & Parry

(57) ABSTRACT

A steel manhole is provided which includes a steel box having a hole having a bolt hole and formed at an upper portion of the same, a height control pipe having a vertical longitudinal hole inserted into an inner diameter portion of the hole, a multi-hole lid for covering an upper portion of the height control pipe, a male screw formed at left and right portions of the steel box and having a male screw portion, and a female screw having a thread portion for being threaded with the male screw pipe.

7 Claims, 4 Drawing Sheets

STEEL MANHOLE

BACKGROUND OF THE INVENTION

1. Field of the Invention

The present invention relates to a steel manhole, and in particular to a steel manhole which is capable of implementing an easier communication cable installation under the ground and an easier check and maintenance of a drain pipe.

2. Description of the Background Art

Generally, a manhole is fabricated by pouring cement into a certain shape of a frame, and then the poured cement is hardened. Holes are formed at the left and right portions of the same, and a pipe way is formed in the holes, and then the cement is filled into the gaps between the holes and the pipe way.

However, the above-described work is complicated, and no work is done until the cement is fully hardened. In addition, since the formation period of the manhole is long, traffic must be detoured.

In addition, the construction site of the manhole is dangerous, and the cost for treating waste obtained after the manhole is fabricated is increased.

Since the water prevention is not guaranteed between the holes of the manhole and the connected portions of the pipe way, rain may penetrate into the manhole. In this case, water must be removed when maintaining the electric system or communication system.

SUMMARY OF THE INVENTION

Accordingly, it is an object of the present invention to provide a steel manhole which is capable of significantly decreasing the construction period and obtaining a recycling of the manhole and decreasing the amount of a source material.

To achieve the above object, there is provided a steel manhole which includes a steel box having a hole having a bolt hole and formed at an upper portion of the same, a height control pipe having a vertical longitudinal hole inserted into an inner diameter portion of the hole, a multi-hole lid for covering an upper portion of the height control pipe, a male screw formed at left and right portions of the steel box and having a male screw portion, and a female screw having a thread portion for being threaded with the male screw pipe.

The front and rear surfaces of the steel box are protruded, and a reinforcing steel is welded at an outer surface.

To achieve the above object, there is provided a steel manhole which includes a wave form steel pipe, a hole formed at an intermediate upper surface portion of the wave form steel pipe and having a plurality of holes at a side surface, a height control pipe inserted into the hole and having a plurality of height control holes at a portion corresponding to the hole, and a multi-hole lid inserted into the upper portion of the hole and covering the upper portion of the same.

The waveform steel pipe includes a gathering chamber at a bottom portion opposite to the hole formed on an upper surface.

Additional advantages, objects and features of the invention will become more apparent from the description which follows.

BRIEF DESCRIPTION OF THE DRAWINGS

The present invention will become more fully understood from the detailed description given herein below and the accompanying drawings which are given by way of illustration only, and thus are not imitative of the present invention, and wherein.

DETAILED DESCRIPTION OF THE PREFERRED EMBODIMENTS

Figure 1:
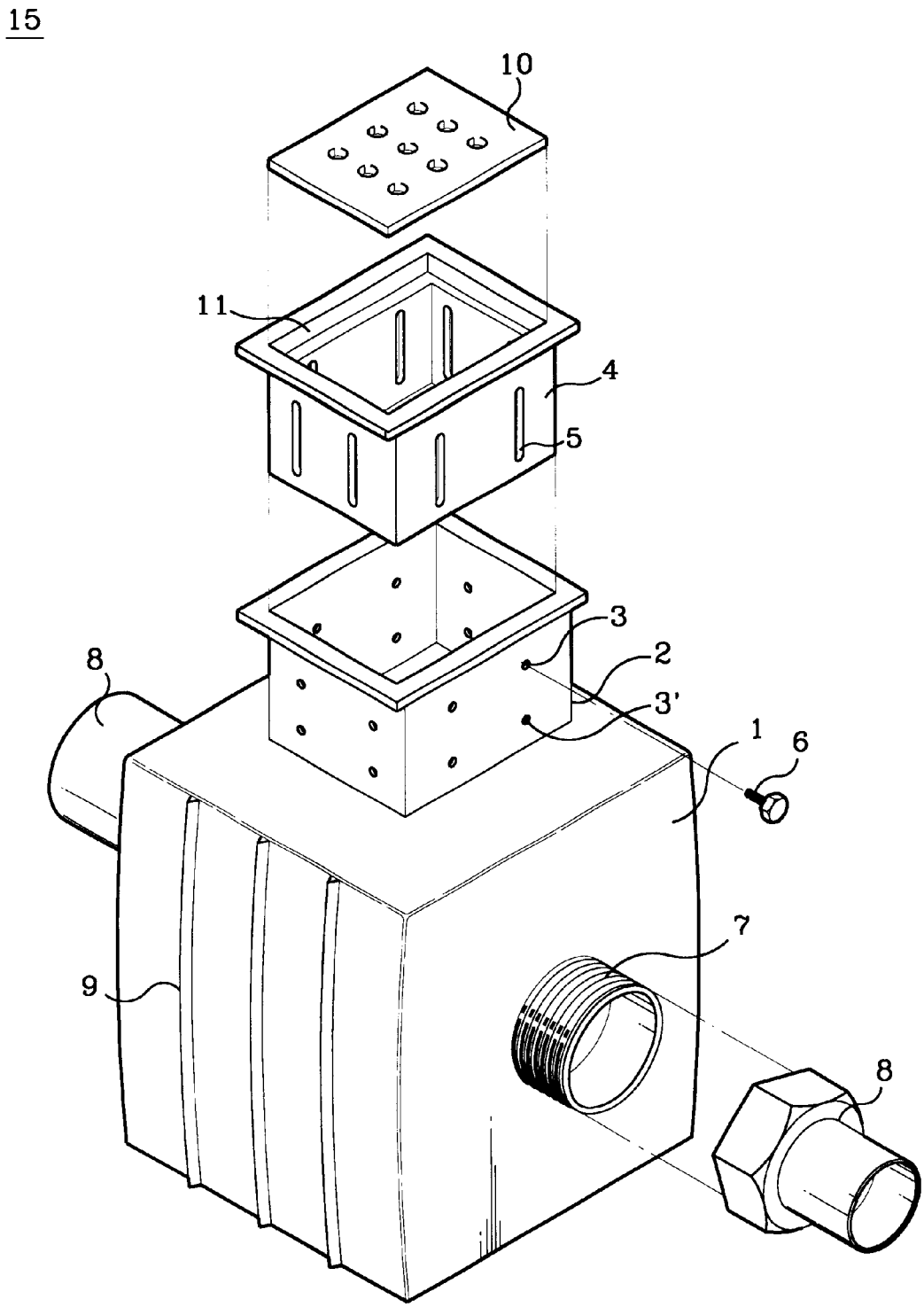
FIG. 1 is an exploded perspective view illustrating a steel manhole according to a first embodiment of the present invention.
Figure 2:
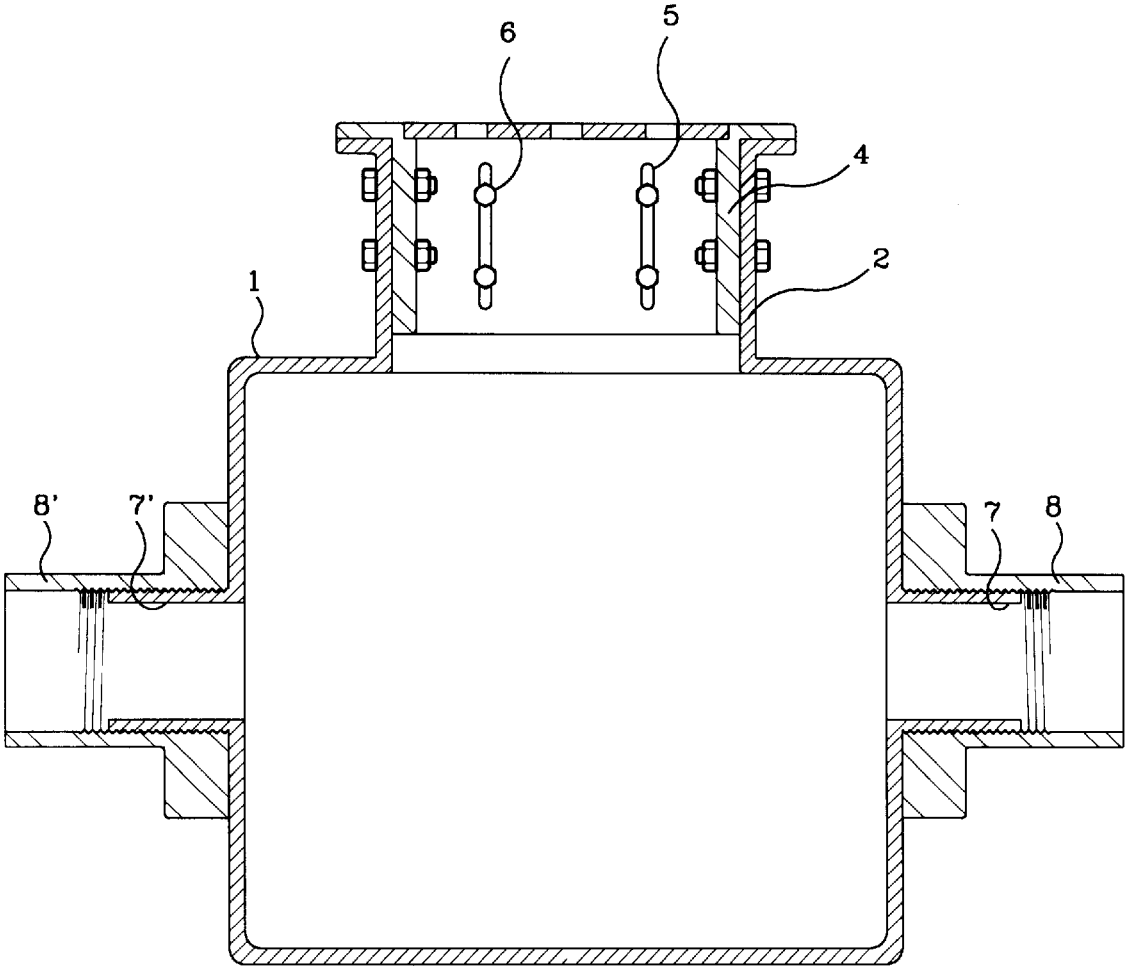
FIG. 2 is a cross-sectional view illustrating a steel manhole according to a first embodiment of the present invention.

FIG. 1 is an exploded perspective view illustrating a steel manhole according to a first embodiment of the present invention, and FIG. 2 is a cross sectional view illustrating a steel manhole according to the first embodiment of the present invention.

As shown therein, a steel manhole 15 includes a hollow casing 2 formed on an upper surface of a rectangular steel box 1. A worker goes into an underground construction site through the casing 2. Two bolt holes 3 and 3' are formed on each surface of the casing 2 at upper and lower portions. A height control pipe 4 is installed at an upper inner surface of the casing 2.

A plurality of vertical longitudinal slots 5 are formed in each surface of the height control pipe 4, and bolts 6 are inserted into the bolt holes 3 and 3' and the vertical longitudinal slot 5, so that the height of the height control pipe 4 is properly controlled, and nuts are engaged with the bolts 6, and the height control pipe 4 is assembled.

Steel male screw pipes 7 and 7' are welded at left and right portions of the steel box 1, and resin female screw connection pipes 8 and 8' are threaded with the male screws 7 and 7'.

A resin pipe way is connected using the male screw pipes 7 and 7' and the female screw pipes 8 and 8', and the front and rear surfaces of the steel box 1 are outwardly protruded, and a plurality of reinforcing steel ribs 9 are welded to the outer surface.

In addition, a shoulder portion 11 is formed at an upper inner surface of the height control pipe 4, and a multi-hole lid 10 which serves as a lid of the manhole covers the shoulder 11.

Figure 3:
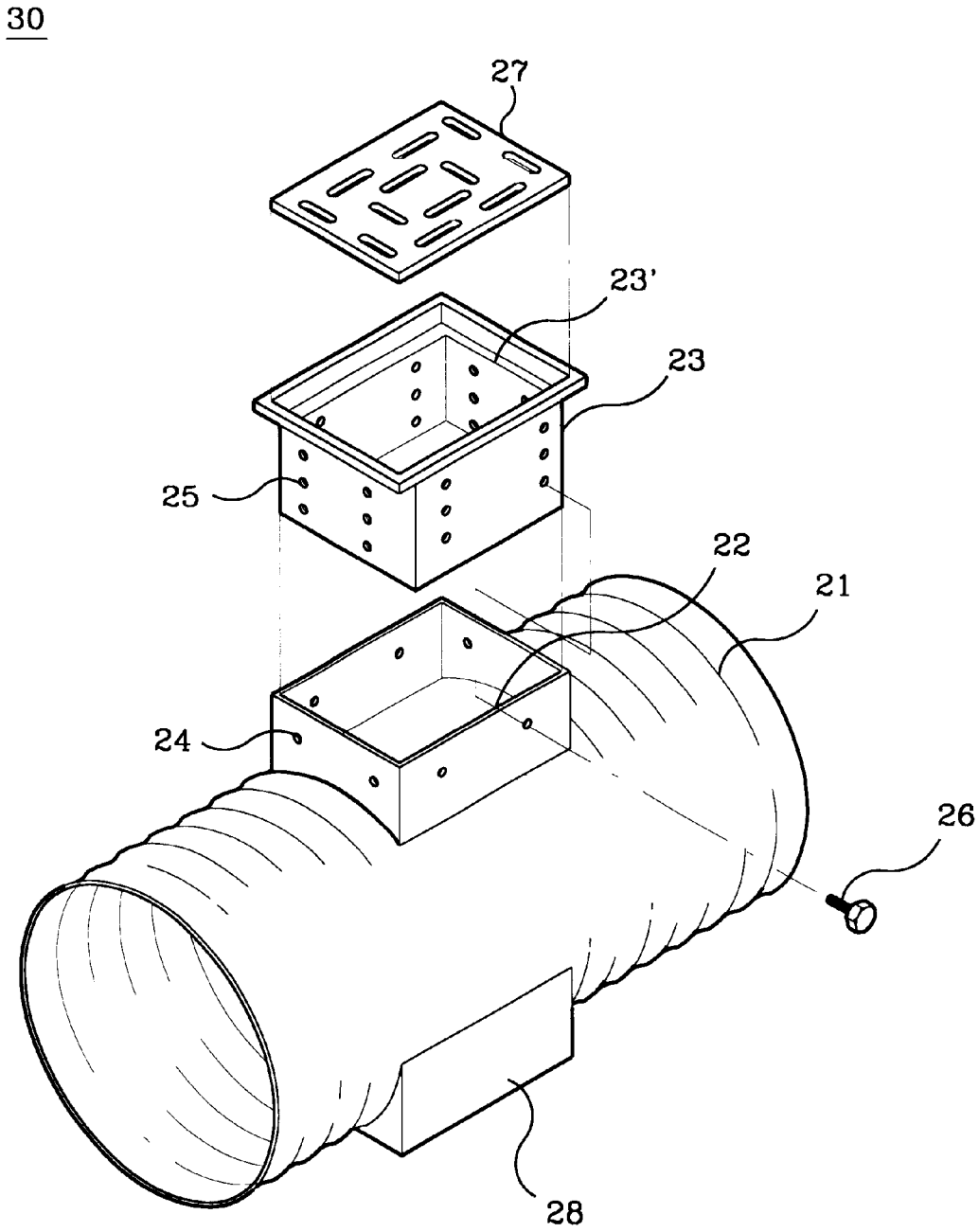
FIG. 3 is an exploded perspective view illustrating a steel man according to a second embodiment of the present invention.
Figure 4:
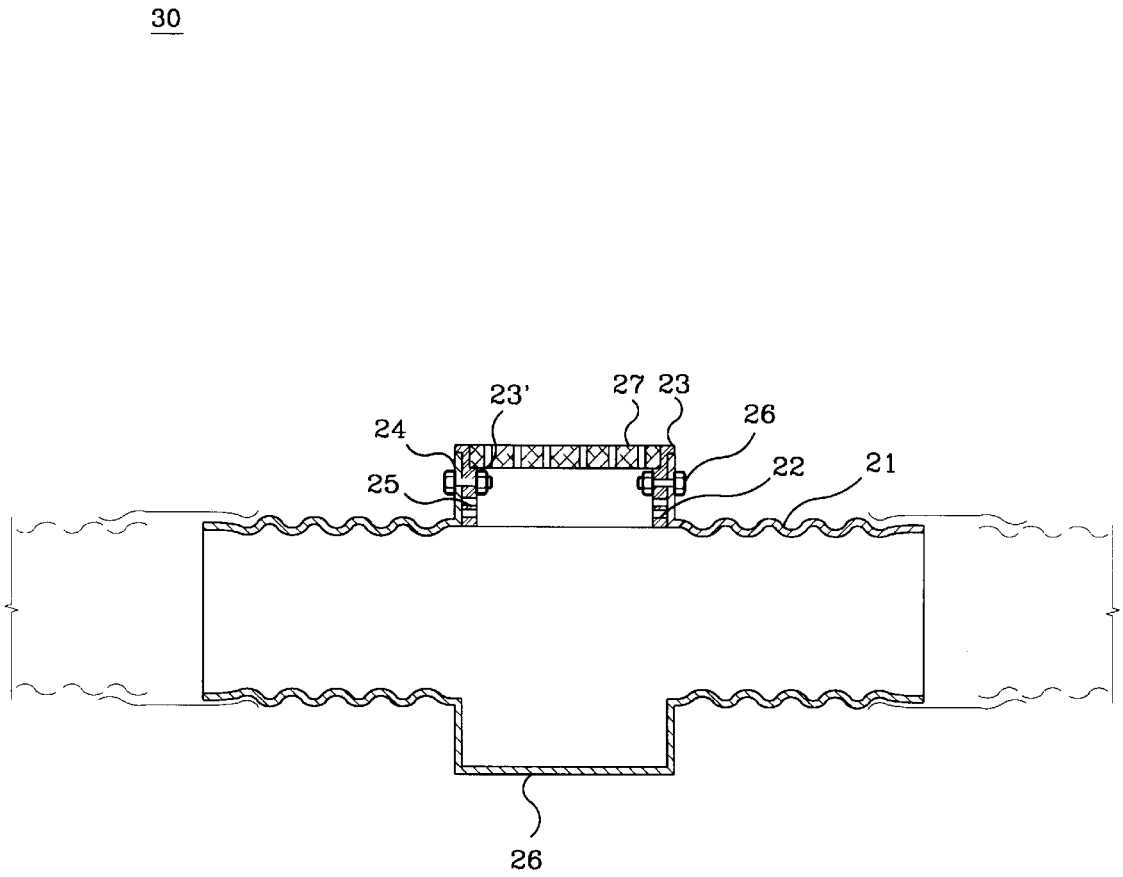
FIG. 4 is a cross-sectional view illustrating a steel manhole according to a second embodiment of the present invention.

FIG. 3 is an exploded perspective view illustrating a steel man according to a second embodiment of the present invention, and FIG. 4 is a cross-sectional view illustrating a steel manhole according to the second embodiment of the present invention.

As shown therein, a steel manhole 30 includes hollow casing 22 formed at an intermediate upper surface of a wave form steel pipe 21, so that a worker goes into an underground construction site through the casing 22.

The shape of the casing 22 may be rectangular or circular, and a height control pipe 23 is inserted into the casing 22 and has the same shape as the casing 22.

A plurality of holes 24 are formed in the casing 22, and height control slots 25 are formed in the walls of the height control pipe 23 at a spacing corresponding to the spacing of the holes 24.

When assembling the manhole in a road, bolts 26 are inserted into holes 24 and the height control casing 25 after inserting the height control pipe 23 into the casing 22 so that the height of the manhole and the height of the road coincide.

A shoulder portion 23 is formed at an upper inner surface of the height control pipe 23, and a lid 27 which surface as a lid of the manhole covers the shoulder portion 23.

In addition, a collection chamber 28 is formed at the bottom portion to correspond with the casing 22, so that waste is collected at the chamber 28 for thereby preventing blocking. In another embodiment of the present invention, the collection chamber may be omitted.

When installing the manhole, a wave form pipe is connected at both ends of the wave form steel pipe 1 using a coupling band.

Therefore, the steel manhole according to the present invention is simply moved to the construction site for thereby completing the construction. In the present invention, and construction is possible in the winter season. The time of construction is significantly decreased, and traffic need not be detoured during the construction period. In addition, it is possible to prevent any accident.

The connection between the electricity and communication cable way are fully sealed. Therefore, rain will do not penetrate into the connected portions. Recycling of the manhole is possible, and it does not require any waste processing cost.

In addition, the present invention is well applicable for soft ground area and sinking areas.

The height of the manhole is controlled by controlling the height control member in the casing based on a bolt engagement for thereby implementing an accurate construction. Since the manhole is fabricated not at the fabrication site but at the factory, the quality of the product is good, and a client-demand design is possible in the present invention.

The manhole is light by separating the height control pipe and the lid, and it is easy to move the same, and any damage and cracks may be prevented.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A steel manhole, comprising:

a steel box having an integral hollow casing formed at an upper portion of the steel box;

a height control pipe secured in said casing in a height adjusted position therein;

a multi-hole lid covering an upper portion of the height control pipe;

male pipes having external male threads projecting at left and right portions of the steel box; and connection pipes having female threads threaded on said male threads.

2. The manhole of claim 1, comprising steel reinforcements welded at an outer surface of said steel box.

3. The manhole of claim 1, wherein said connection pipes are made of a resin material.

4. The manhole of claim 1, wherein said height control pipe has vertical slots aligned with holes in said casing and fastening elements are provided to secure the height control pipe in the casing in the height adjusted position in said casing.

5. The manhole of claim 1, wherein said steel box is rectangular.

6. A steel manhole, comprising:

a wave form steel pipe;

a hollow casing projecting upwardly at an intermediate upper surface portion of the wave form steel pipe and having a plurality of holes at a side surface thereof;

a height control pipe inserted into said casing and having a plurality of height control holes at positions corresponding to the holes in the casing, a multi-hole lid inserted into an upper portion of the casing to cover the upper portion of the casing, and a gathering chamber formed at a lower portion of the wave form steel pipe opposite the casing on the upper surface of the wave form steel pipe.

7. The manhole of claim 6, comprising fastening elements extending in the holes in the height control pipe and in said casing to secure the pipe in the casing in a height adjusted position therein.

* * * * *